US011241601B2

(12) United States Patent
Sorin et al.

(10) Patent No.: US 11,241,601 B2
(45) Date of Patent: Feb. 8, 2022

(54) ADJUSTABLE EXERCISE BAR APPARATUS AND METHODS OF USING SAME

(71) Applicants: Albert Sorin, Lexington, SC (US); Richard Sorin, Lexington, SC (US)

(72) Inventors: Albert Sorin, Lexington, SC (US); Richard Sorin, Lexington, SC (US)

( * ) Notice: Subject to any disclaimer, the term of this patent is extended or adjusted under 35 U.S.C. 154(b) by 0 days.

(21) Appl. No.: 17/124,592

(22) Filed: Dec. 17, 2020

(65) Prior Publication Data

US 2021/0178218 A1 Jun. 17, 2021

Related U.S. Application Data

(60) Provisional application No. 62/949,277, filed on Dec. 17, 2019.

(51) Int. Cl.
*A63B 21/072* (2006.01)
*A63B 21/00* (2006.01)
*A63B 23/035* (2006.01)

(52) U.S. Cl.
CPC ..... *A63B 21/0724* (2013.01); *A63B 21/0728* (2013.01); *A63B 21/4035* (2015.10); *A63B 23/03525* (2013.01); *A63B 2225/09* (2013.01)

(58) Field of Classification Search
CPC ..... A63B 21/0724
See application file for complete search history.

(56) References Cited

U.S. PATENT DOCUMENTS 4,018,442 A * 4/1977 Galler ..... A63B 21/0724 482/106
D261,788 S * 11/1981 Burns ..... D21/682
D317,641 S * 6/1991 Gerard ..... D21/682
D320,249 S * 9/1991 Gerard ..... D21/682
5,725,461 A * 3/1998 Bogard, II ..... A63B 21/072 482/106
6,679,815 B2 * 1/2004 Vittone ..... A63B 21/06 482/106
9,254,408 B1 * 2/2016 Otto ..... A63B 21/4045
D776,209 S * 1/2017 Gilbert ..... D21/683
9,833,654 B1 12/2017 Gant et al.
D888,166 S * 6/2020 Henniger ..... D21/679
10,773,116 B2 * 9/2020 Vanderbleek ..... A63B 21/4035
10,799,752 B1 * 10/2020 Mattox ..... A63B 21/0724
10,881,893 B2 * 1/2021 Welde ..... A63B 21/0724
10,888,730 B2 * 1/2021 Rella ..... A63B 71/0054
2002/0137603 A1 9/2002 Vittone et al.
2012/0295468 A1 * 11/2012 Campbell ..... H01R 13/625 439/352
2017/0106226 A1 4/2017 Mann
2018/0178052 A1 * 6/2018 Rella ..... A63B 21/075
2020/0230457 A1 * 7/2020 Vanderbleek ..... A63B 23/0405

OTHER PUBLICATIONS

Iron Hos YouTube Channel; date Aug. 12, 2013 https://www.youtube.com/watch?v=D0J25iBE9Do.

* cited by examiner

*Primary Examiner* — Joshua Lee

(74) *Attorney, Agent, or Firm* — Todd A. Serbin; Nexsen Pruet, LLC

(57) ABSTRACT

An adjustable exercise bar, comprising: a main body sized and shaped for disposition of a user therein, including at least one channel therethrough; at least one handle bar segment, wherein the at least one handle bar segment is insertable into the at least one channel.

17 Claims, 13 Drawing Sheets

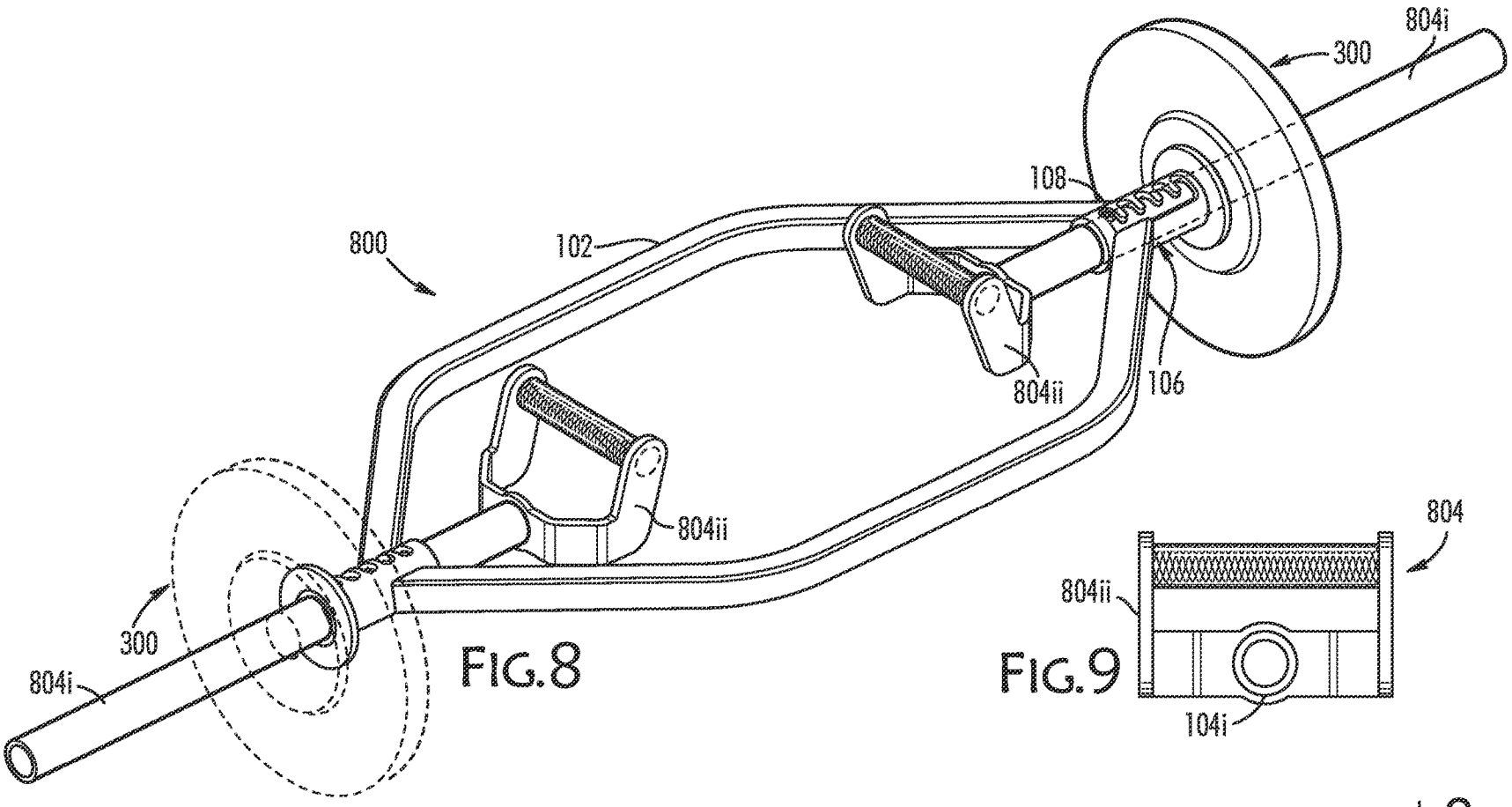
FIG.8
FIG.9
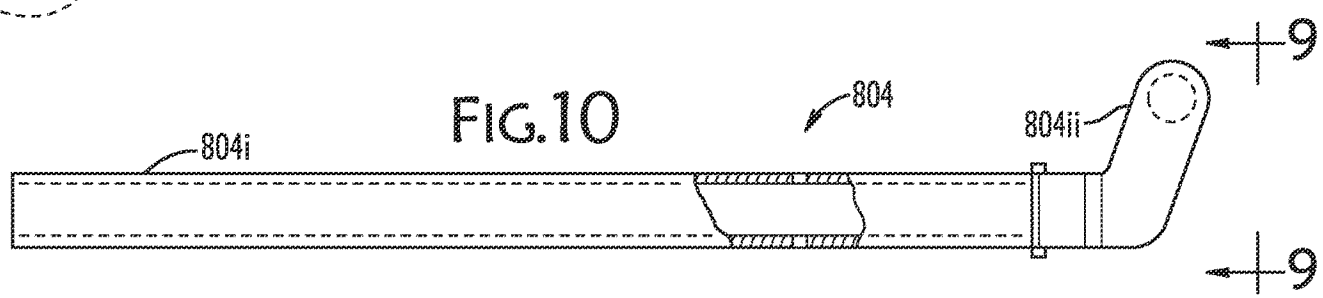
FIG.10

ADJUSTABLE EXERCISE BAR APPARATUS AND METHODS OF USING SAME

RELATED APPLICATIONS

This application claims the benefit of priority under 35 U.S.C. § 119(e) of U.S. Provisional Patent Application No. 62/949,277 filed Dec. 17, 2019, the contents of which are incorporated herein by reference in their entirety.

FIELD OF THE INVENTION

The present invention, in some embodiments thereof, relates to weight training and, more particularly, but not exclusively, to exercise equipment and related methods of use.

BACKGROUND OF THE INVENTION

Weight training is a common type of strength training for developing the strength and size of skeletal muscles. It utilizes the force of gravity in the form of weighted bars, dumbbells or weight stacks in order to oppose the force generated by muscle through concentric or eccentric contraction. Weight training uses a variety of specialized equipment to target specific muscle groups and types of movement.

Weight training usually requires different types of equipment, most commonly dumbbells, barbells, weight plates, and weight machines. Various combinations of specific exercises, machines, dumbbells, and barbells allow trainees to exercise body parts in numerous ways.

A previous attempt to provide weight training equipment includes the Sorinex® Diamond Bar™, offered for sale at sorinex.com/products/diamond-bar.

SUMMARY OF THE INVENTION

According to an aspect of some embodiments of the present invention there is provided an adjustable exercise bar, comprising: a main body sized and shaped for disposition of a user therein, including at least one channel therethrough; at least one handle bar segment, wherein the at least one handle bar segment is insertable into the at least one channel.

In an embodiment of the invention, the main body is multi-sided.

In an embodiment of the invention, the main body is hexagonal.

In an embodiment of the invention, the main body is square or rectangular.

In an embodiment of the invention, the main body is triangular.

In an embodiment of the invention, the main body is ovoid, oblong or circular.

In an embodiment of the invention, the at least one handle bar segment has a rod and a handle.

In an embodiment of the invention, the handle is raised.

In an embodiment of the invention, the at least one channel is located on an apex of the main body.

In an embodiment of the invention, the at least one channel is located on a flat portion of the main body.

In an embodiment of the invention, the at least one channel is located on a curved portion of the main body.

In an embodiment of the invention, the at least one handle bar segment has a stud located thereon.

In an embodiment of the invention, the exercise bar further comprises a locking mechanism located on the main body formed as a counterpart to the stud.

In an embodiment of the invention, the locking mechanism has at least one slot formed therein as a counterpart to the stud.

In an embodiment of the invention, the exercise bar further comprises a barrier located on either the main body or on the at least one handle bar segment.

In an embodiment of the invention, the rod is shape and sized for the placement of at least one weight plate thereon.

According to an aspect of some embodiments of the present invention there is provided a method of using an adjustable exercise bar, comprising: sliding at least one handle bar segment within a channel located through a main body of the adjustable exercise bar.

In an embodiment of the invention, the method further comprises reversibly rotating the at least one handle bar segment to position a stud located on the handle bar segment in a slot located in a locking mechanism of the main body.

In an embodiment of the invention, the method further comprises placing a weigh plate on the at least one handle bar segment.

In an embodiment of the invention, the method further comprises exercising using the exercise bar while grasping the at least one handle bar segment.

In an embodiment of the invention, the actions are performed in any order.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example, are not necessarily to scale, and are for purposes of illustrative discussion of embodiments of the invention. In this regard, the description taken with the drawings makes apparent to those skilled in the art how embodiments of the invention may be practiced.

In the drawings:

FIG. 8 is a perspective view of an adjustable exercise bar with raised handles, in an embodiment of the invention;

FIG. 9 is a front view of a raised handle segment, in an embodiment of the invention;

FIG. 10 is a side view of a raised handle segment, in an embodiment of the invention;

DESCRIPTION OF SPECIFIC EMBODIMENTS OF THE INVENTION

Figure 1:
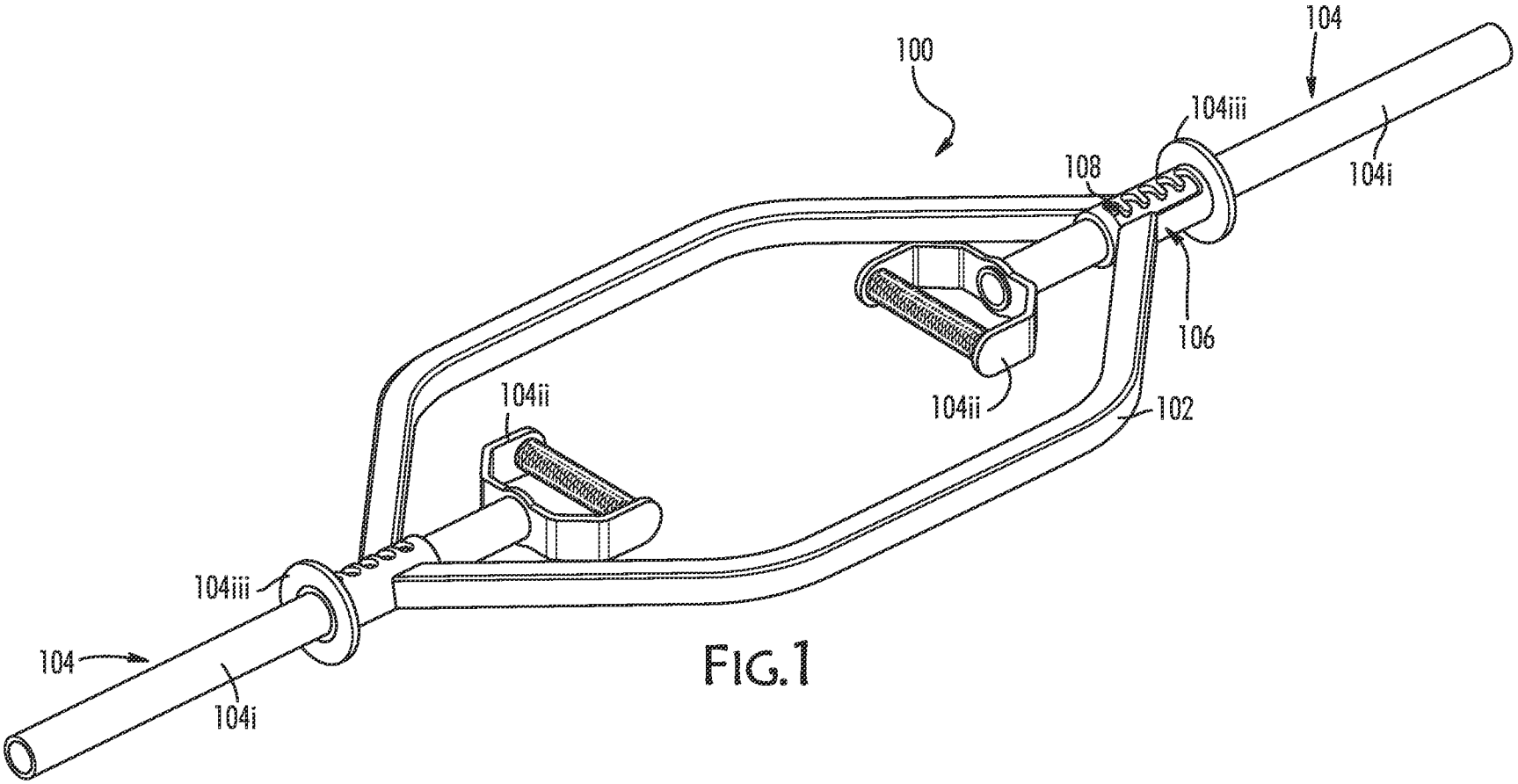
FIG. 1 is a perspective view of an adjustable exercise bar, in an embodiment of the invention.

The present invention, in some embodiments thereof, relates to human fitness and, more particularly, but not exclusively, to exercise equipment and related methods of use.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1 is a perspective view of an adjustable exercise bar 100, in an embodiment of the invention. The adjustable exercise bar, in an embodiment of the invention, includes a main body 102 and two handle segments 104. In an embodiment of the invention, the main body 102 is sized and shaped for the disposition of a user therein, for example, being conscribed or bounded by the main body 102 itself. In some embodiments of the invention, the main body 102 is hexagonally shaped. Optionally, it is quadrilateral, such as rectangular or square. In some embodiments of the invention, it is ovoid, circular or oblong. In some embodiments of the invention it is triangular. In some embodiments of the invention, it has more than 4 sides, such as the previously described and shown hexagonal shape, but it could be pentagonal or have even more than 6 sides.

The handle segments 104 comprise a rod 104*i* and a handle 104*ii*, in some embodiments of the invention. Generally, the handle segments 104 are insertable into and slidable within channels 202 in the main body 102, such as shown in FIG. 2B. As shown in FIG. 2B, the channels 202 are located at an apex of the hexagonal shape. It should be understood that the channels 202 could be located in a flat portion of the main body 102, for example in a quadrilateral shaped embodiments. In some embodiments, the channels 202 are not located in a flat or apex portion of the main body 102, but in a curved portion, for example, in ovoid, oblong or circular embodiments. It should be understood that the channels 202 are sized and shaped to accommodate the rods 104*i* of the handle segments 104 such that the outer circumference of the rods 104*i* is only slightly smaller than the circumference of the channels so that there is a relatively tight fit between the two, while still enabling insertion and sliding of the rods 104*i* within the channels 202. As shown in FIG. 1, the ends of rods 104*i* are inserted into the channels 202 from inside the main body 102 and are slid towards the outside of the main body 102 until a desired position of the handle segments 104 is attained. Typically, the handle segments 104 are positioned equally on each side, however, in some cases they could be intentionally positioned uneven. The handle segments 104 are rotated to reversibly lock them into a locking mechanism 106 which is provided with at least one slot, within which a stud 108 is inserted. Such an operation is described in more detail with respect to FIGS. 7A-7C and 13. It should be understood that the shape and size configuration of the main body 102 is not only intended for disposition of a user therein, but also to allow for the insertion, movement and use of the handle segments 104 into and out of the changes 202.

In some embodiments of the invention, the handles 104*ii* are knurled or are otherwise contoured to enhance their ergonomic quality or grip-ability by a user 1100.

Figure 2A:
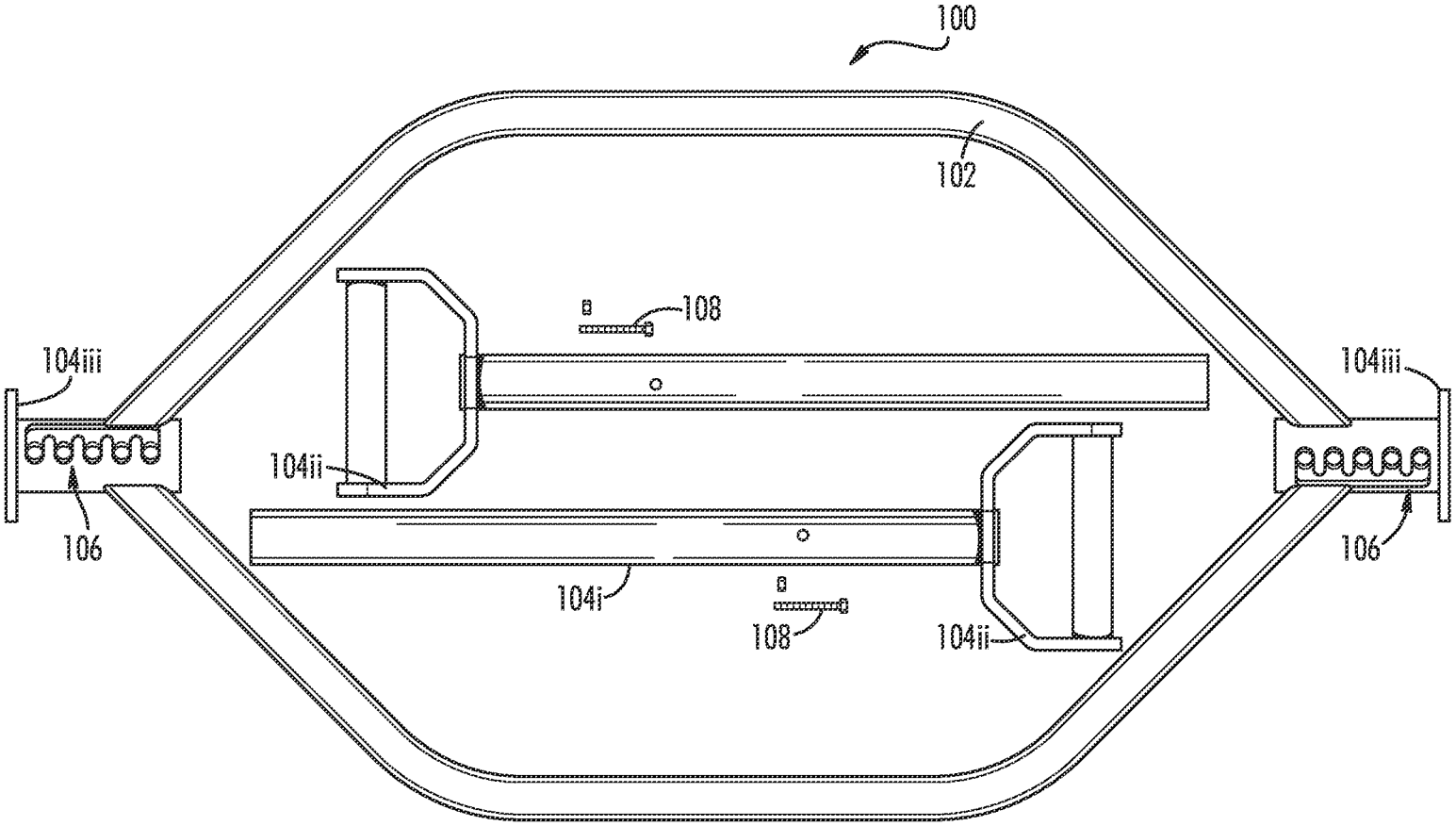
FIG. 2A is a top view of the disassembled adjustable exercise bar of FIG. 1, in an embodiment of the invention.
Figure 2B:
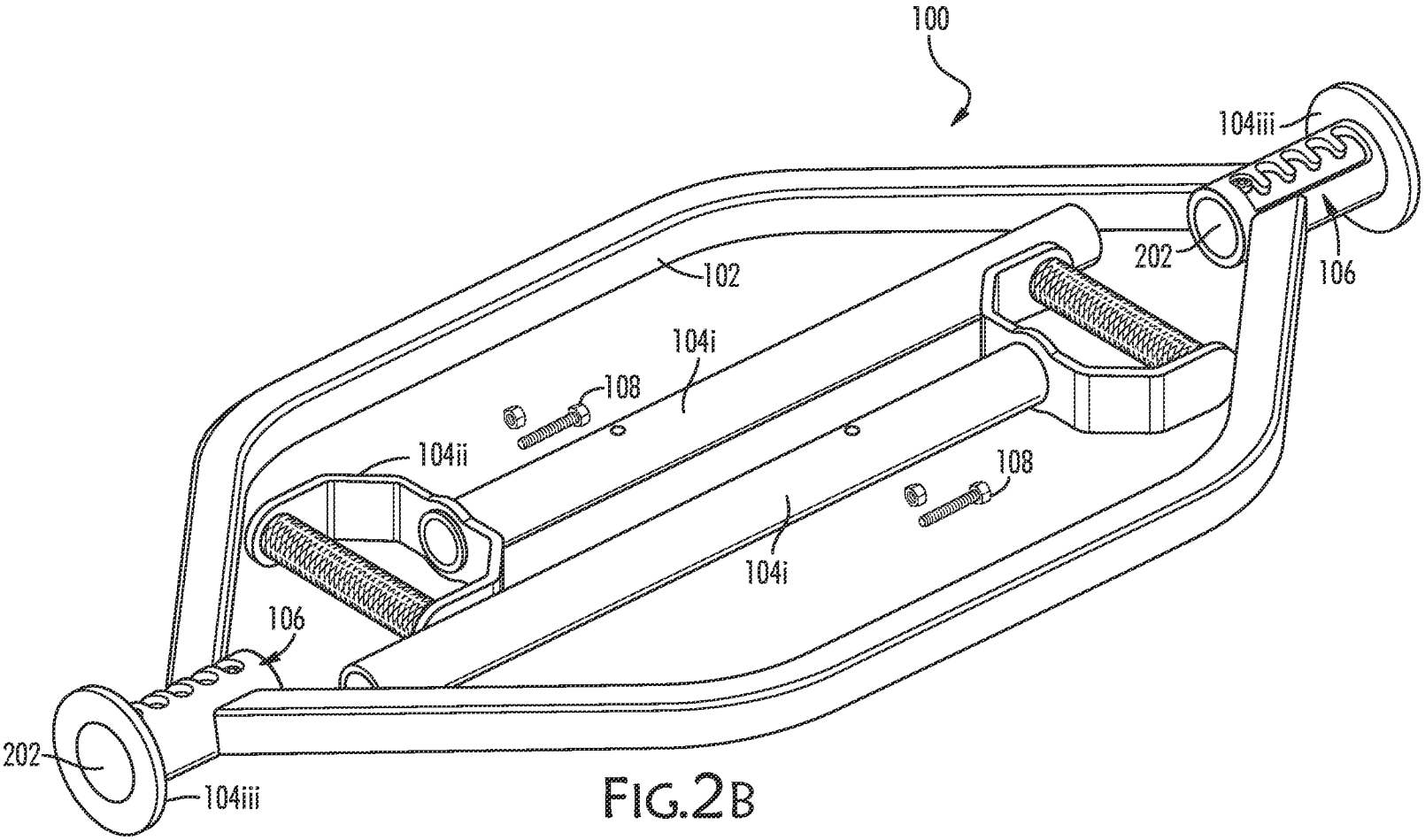
FIG. 2B is a perspective view of the disassembled adjustable exercise bar of FIG. 1, in an embodiment of the invention.

In some embodiments of the invention, a barrier 104*iii* is also disposed on the handle segment 104, however, in some embodiments the barrier 104*iii* is attached to the main body 102 instead, such as shown in FIGS. 2A and 2B. In an embodiment of the invention, weight plates 300 which are placed on the rods 104*i* for performing weight training exercises are advanced on the rods 104*i* until they abut the barrier 104*iii*, such as shown in FIG. 3.

FIG. 2A is a top view of the disassembled adjustable exercise bar 100 of FIG. 1, in an embodiment of the invention. Shown in a little more detail are the handle segments 104, including the rods 104*i* and handles 104*ii*. In addition, it can be seen that the stud 108 can be the top of a screw which is screwed into a hole located in each rod 104*i*. It should be understood that the stud 108 is sized and shaped to act as a counterpart to the at least one slot of the locking mechanism 106.

Figure 3:
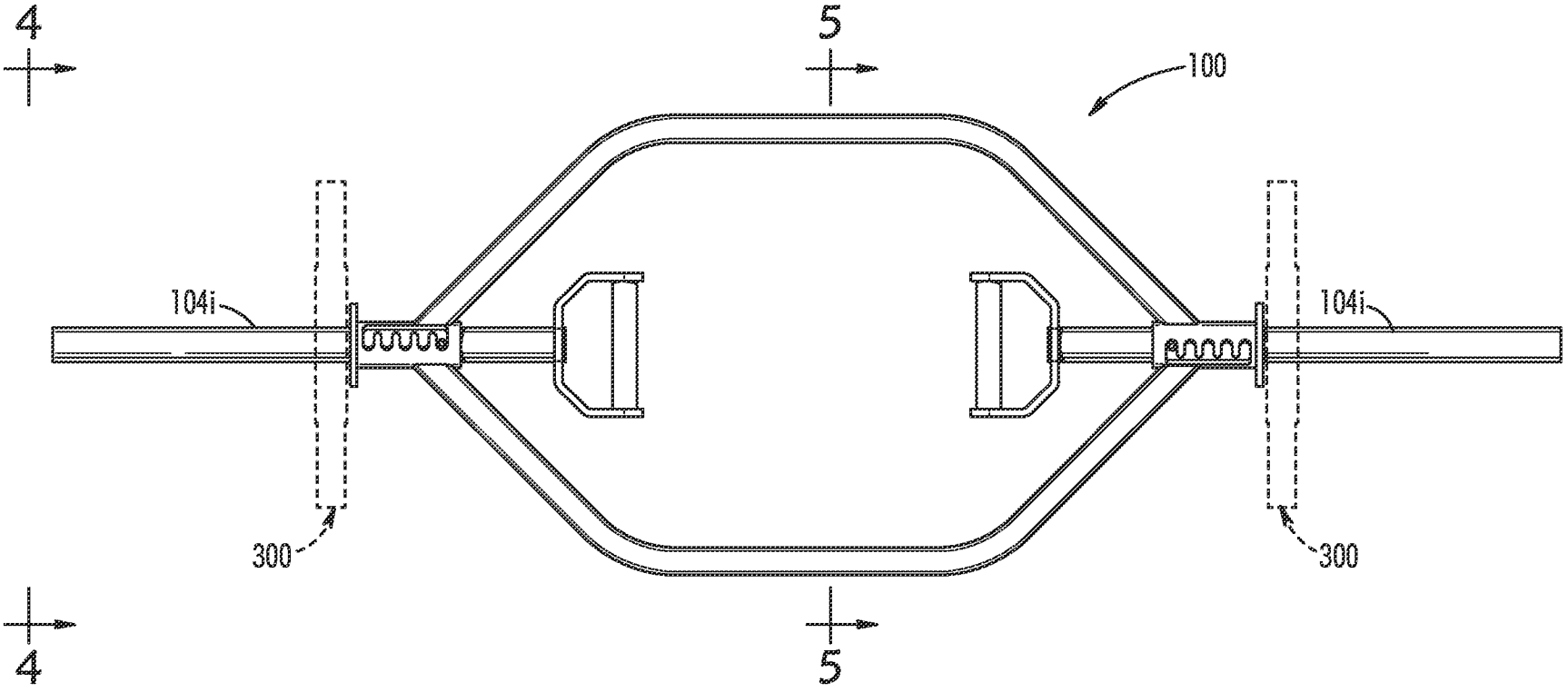
FIG. 3 is a top view of the assembled adjustable exercise bar of FIG. 1, in an embodiment of the invention.
Figure 4:
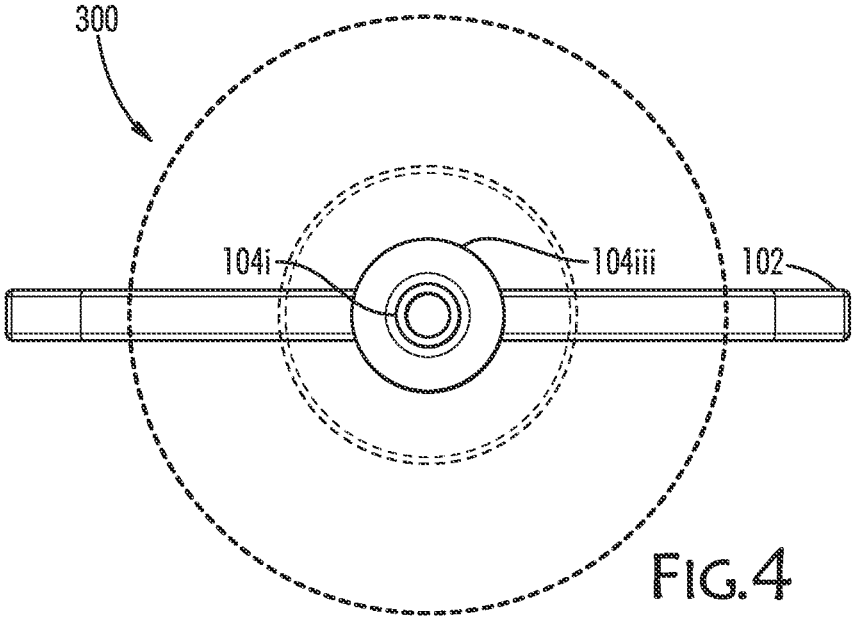
FIG. 4 is a side view of the assembled adjustable exercise bar of FIG. 3, in an embodiment of the invention.
Figure 5:
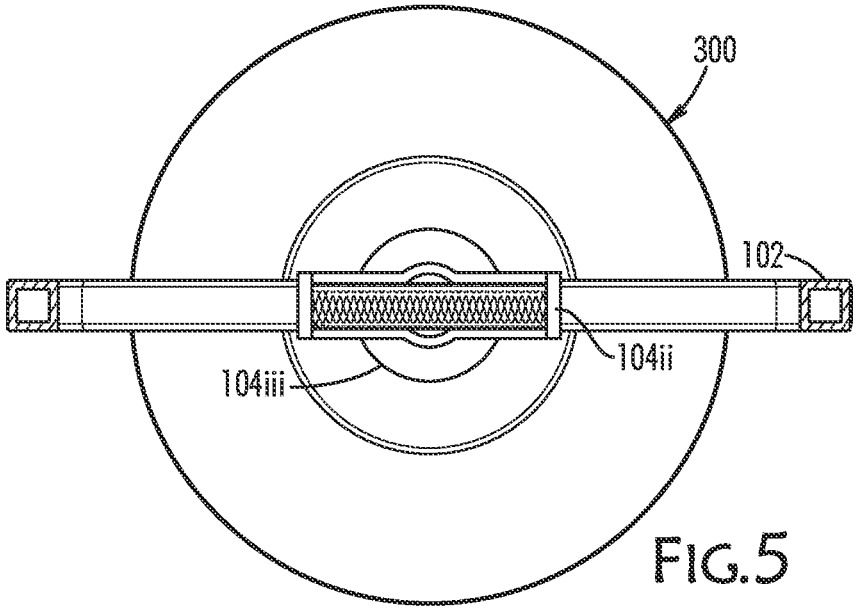
FIG. 5 is a cross-sectional view of the assembled adjustable exercise bar of FIG. 3, in an embodiment of the invention.

FIG. 4 is a side view of the assembled adjustable exercise bar 100 of FIG. 3 which has the addition of at least one weight plate 300, in an embodiment of the invention. FIG. 5 is a cross-sectional view of the assembled adjustable exercise bar of FIG. 3 which has the addition of at least one weight plate 300, in an embodiment of the invention.

Figure 6:
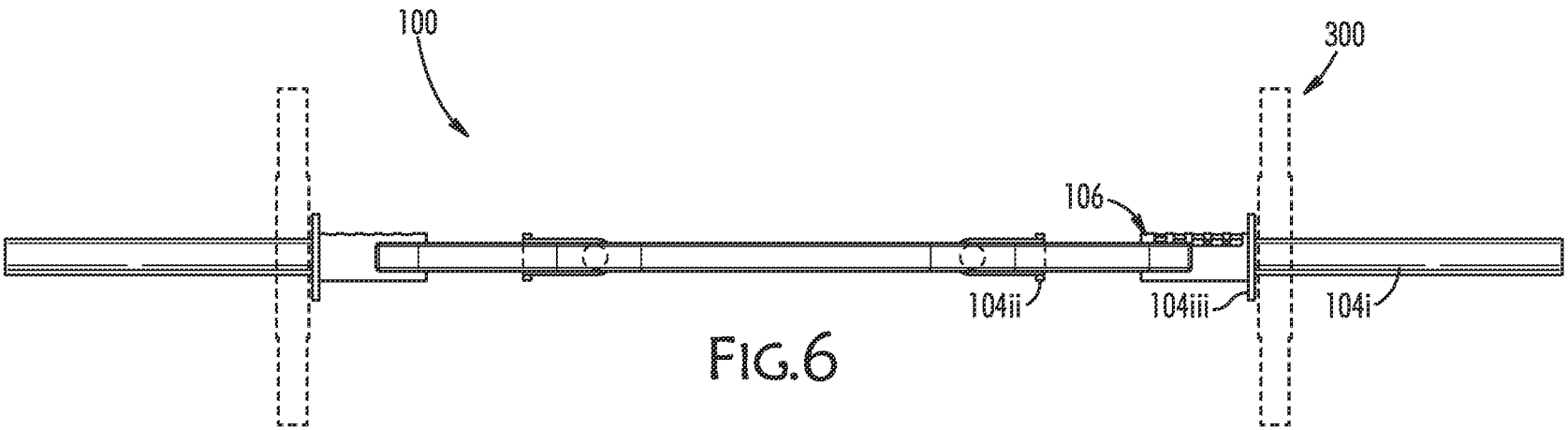
FIG. 6 is a front or rear view of the assembled adjustable exercise bar of FIG. 1, in an embodiment of the invention.

FIG. 6 is a front or rear view of the assembled adjustable exercise bar 100 of FIG. 1, in an embodiment of the invention.

Figure 7A:
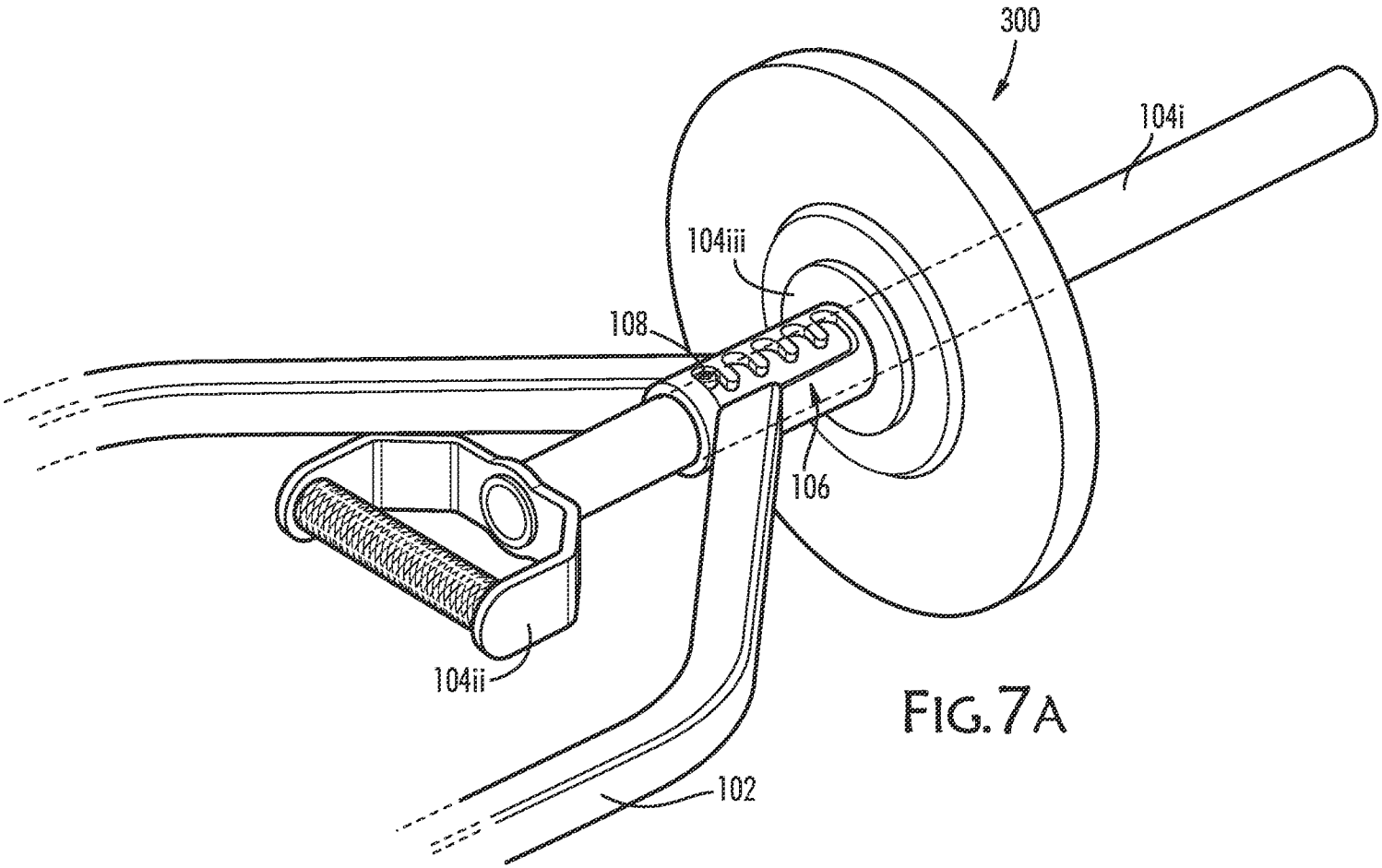
FIGS. 7A-7C are close-up perspective views of a portion of the assembled adjustable exercise bar of FIG. 1 showing an adjustment method, in an embodiment of the invention.
Figure 7B:
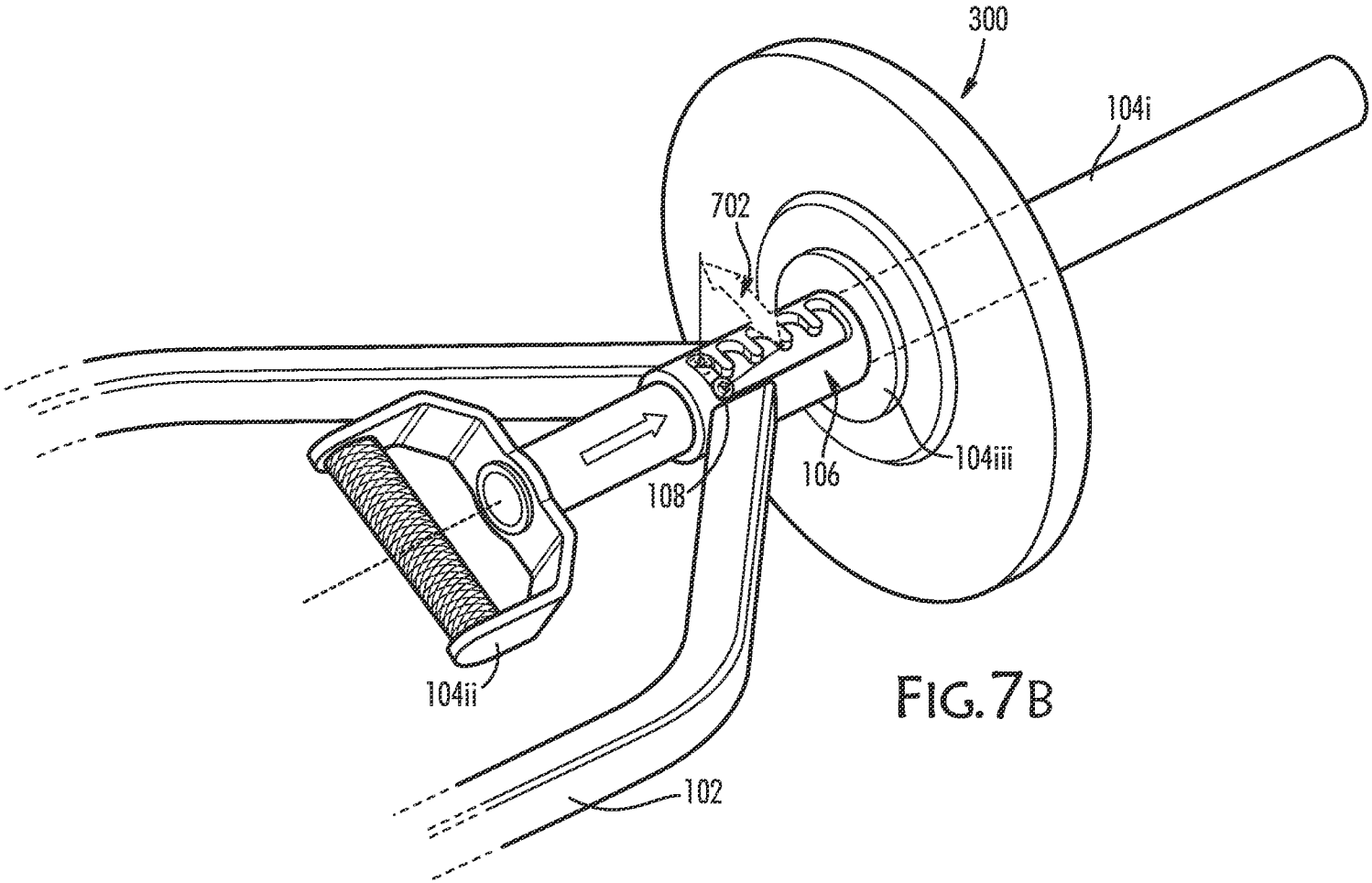
Figure 7C:
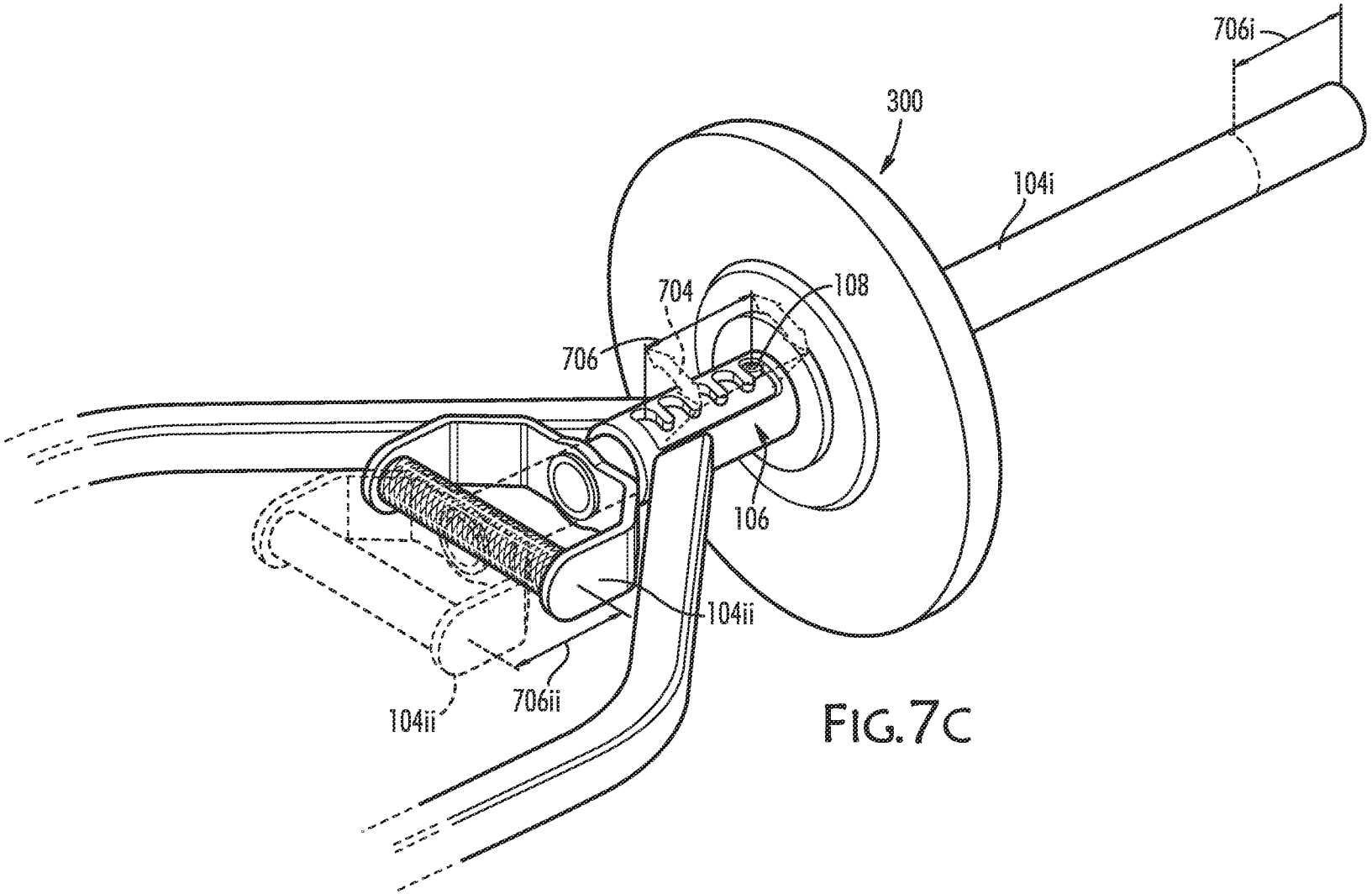
Figure 13:
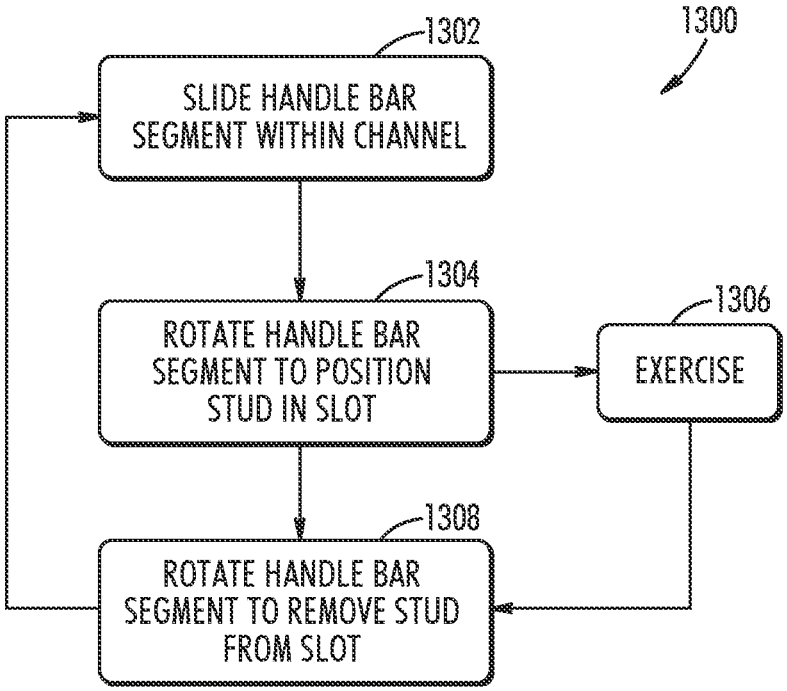

FIGS. 7A-7C are close-up perspective views of a portion of the assembled adjustable exercise bar 100 of FIG. 1 showing an adjustment method 1300, in an embodiment of the invention. For brevity, at least a part of the method of adjusting and using an adjustable exercise bar of FIG. 13 is discussed in conjunction with FIGS. 7A-7C. FIG. 7A shows one side of the exercise bar 100 wherein a handle bar segment 104 has been inserted into a channel 202 of the main body 102 and a stud 108 is inserted into at least one slot of the locking mechanism 106. Also shown in FIG. 7A is a weight plate 300 which is placed onto the rod 104*i* of the handle bar segment 104.

As is shown in FIG. 7B, in an embodiment of the invention, adjustment of the exercise bar 100 is accomplished by rotating (1308) the handle bar segment 104 in a clockwise direction 702 such that the stud 108 displaces out of the slot of the locking mechanism 106. The overall length of the exercise bar 100 and/or the position of the handles 104*ii* is adjusted by sliding (1302) the rod 104*i* within the channel to a desired position.

In an embodiment of the invention, once the handle bar segment 104 has achieved the desired position, it is rotated (1304) in a direction 704 opposite the one shown in FIG. 7A, such that the stud 108 is inserted into a second slot of the locking mechanism 106, wherein the second slot corresponds to the desired position referred to above and wherein once reversibly locked into the second slot, the handle bar segment 104 is maintained in that desired position. Such an operation is shown in FIG. 7C.

It should be understood that while the actions of the method shown in FIG. 13 are described herein as occurring in a certain order, the method can be carried out starting at any action in the sequence, which of course depends on if the bar is being adjusted in between exercises (1306) (for example by different users or in order to perform difference exercises), or is being used for the first time out of storage or out of the box, as examples. As can be seen in FIG. 7C, by sliding (1302) the handle bar segment 104, the overall length of the exercise bar 100 is adjustable corresponding to the difference between the first slot and the second slot chosen. For example, FIG. 7C shows a distance 706 of adjustment from the first slot (previously shown in FIG. 7A) to the second slot. Naturally, the distance 706 traveled between slots is reflected in the change of length 706*i* of the exercise bar 100.

FIG. 8 is a perspective view of an adjustable exercise bar 800 which includes raised handle segments 804 with raised handles 804*ii*, in an embodiment of the invention. Adjustment operation of exercise bar 800 is similar to that of exercise bar 100, however, exercise (1306) is slightly different in that the handles 804*ii* are raised with respect to a plane formed by the main body 102 (as opposed to substantially lying within the plane such as with respect to handles 104*ii*).

FIG. 9 is a front view of a raised handle segment 804, in an embodiment of the invention and FIG. 10 is a side view of a raised handle segment 800, in an embodiment of the invention.

Figure 11:
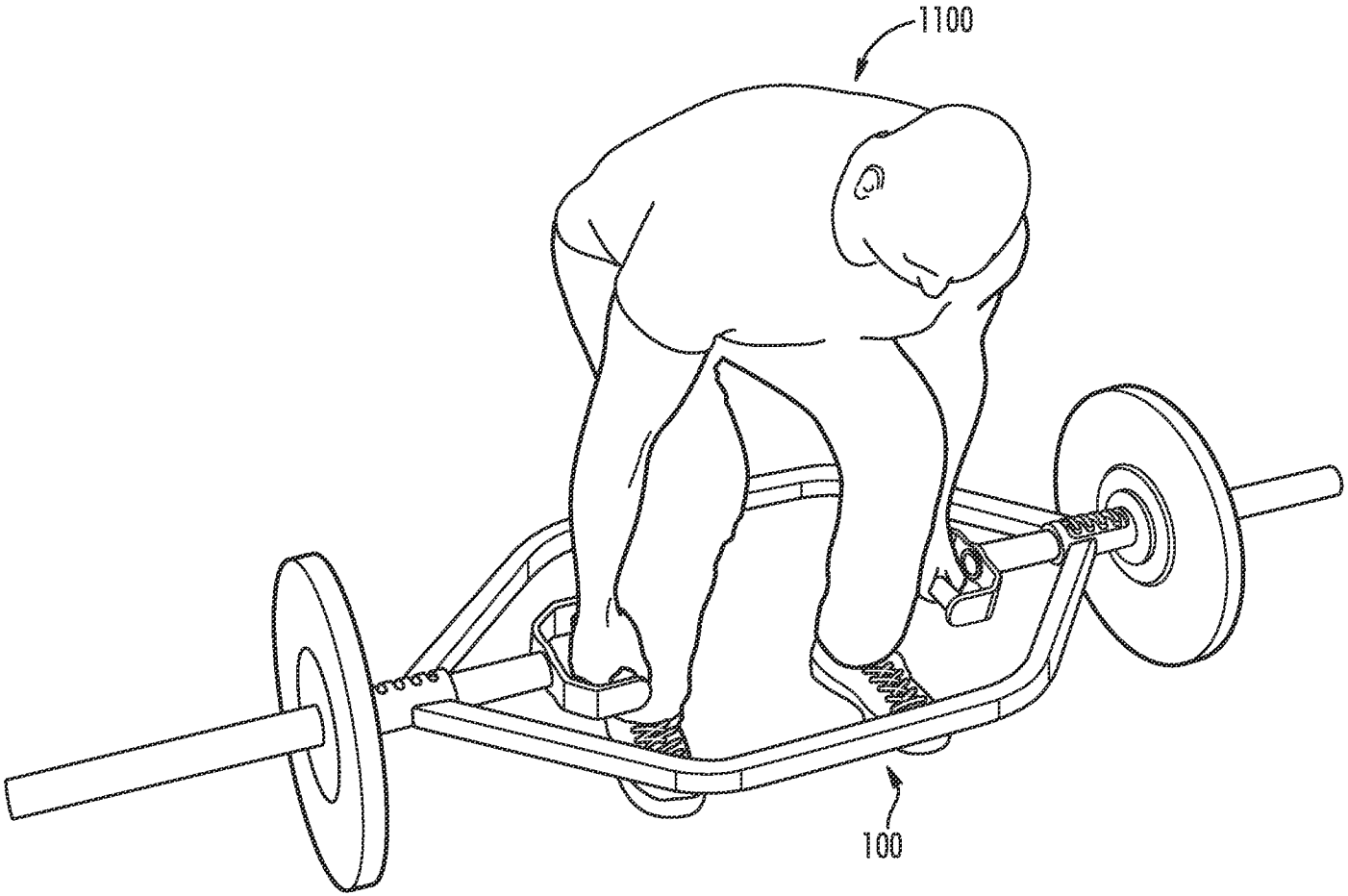
FIG. 11 is a perspective view of a user grasping an adjustable exercise bar, in an embodiment of the invention.
Figure 12:
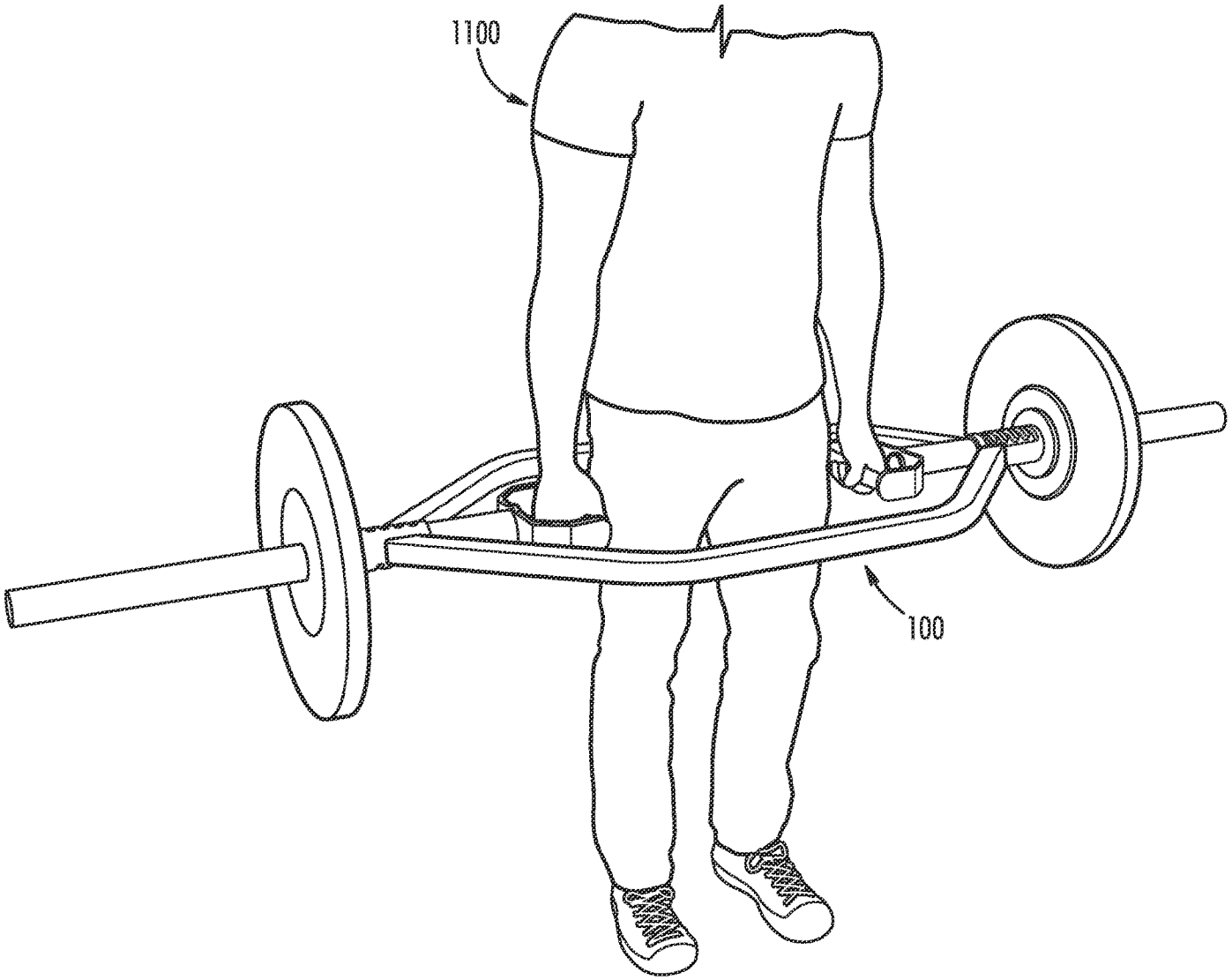
FIG. 12 is a perspective view of a user exercising with an adjustable exercise bar, in an embodiment of the invention; and, FIG. 13 is a flowchart showing a method of adjusting and using an adjustable exercise bar, in an embodiment of the invention.

FIGS. 11 and 12 are perspective views of a user grasping and exercising with an adjustable exercise bar 100, in an embodiment of the invention. It should be understood that use of exercise bar 800 would be substantially similar.

It is expected that during the life of a patent maturing from this application many relevant exercise bars will be developed and the scope of the term diamond or hex bar is intended to include all such new technologies a priori.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. An adjustable exercise bar, comprising:

a main body sized and shaped for disposition of a user therein, including at least one channel therethrough; and, at least one handle bar segment having a rod and a handle combined into one piece, the rod shaped and sized for the placement of at least one weight plate directly thereon and the rod extending through the at least one channel when the adjustable exercise bar is fully assembled for use, wherein the at least one handle bar segment is insertable into and removable from the at least one channel.

2. The adjustable exercise bar of claim 1, wherein the main body is multi-sided.

3. The adjustable exercise bar of claim 2, wherein the main body is hexagonal.

4. The adjustable exercise bar of claim 2, wherein the main body is square or rectangular.

5. The adjustable exercise bar of claim 2, wherein the main body is triangular.

6. The adjustable exercise bar of claim 1, wherein the main body is ovoid, oblong or circular.

7. The adjustable exercise bar of claim 1, wherein the handle is raised.

8. The adjustable exercise bar of claim 1, wherein the at least one channel is located in an apex of the main body.

9. The adjustable exercise bar of claim 1, wherein the at least one channel is located in a flat portion of the main body.

10. The adjustable exercise bar of claim 1, wherein the at least one channel is located in a curved portion of the main body.

11. The adjustable exercise bar of claim 1, wherein the at least one handle bar segment has a stud located thereon.

12. The adjustable exercise bar of claim 11, further comprising a locking mechanism located on the main body formed as a counterpart to the stud.

13. The adjustable exercise bar of claim 12, wherein the locking mechanism has at least one slot formed therein as a counterpart to the stud.

14. The adjustable exercise bar of claim 1, further comprising a barrier located on either the main body or on the at least one handle bar segment.

15. A method of using an adjustable exercise bar, comprising:

removably sliding at least one handle bar segment comprising a rod and a handle, combined into one piece, within a channel located through a main body of the adjustable exercise bar; and, placing a weight plate directly on the rod of the at least one handle bar segment.

16. The method according to claim 15, further comprising reversibly rotating the at least one handle bar segment to position a stud located on the handle bar segment in a slot located in a locking mechanism of the main body.

17. The method according to claim 15, further comprising exercising using the exercise bar while grasping the handle of the at least one handle bar segment.

* * * * *